United States Patent [19]

McGowan et al.

[11] Patent Number: 4,696,412

[45] Date of Patent: Sep. 29, 1987

[54] HINGE CONSTRUCTION FOR CONTAINER COVERS

[75] Inventors: Ronald C. McGowan; Ninh G. Pham, both of Houston, Tex.

[73] Assignee: Igloo Corporation, Chicago, Ill.

[21] Appl. No.: 23,549

[22] Filed: Mar. 9, 1987

[51] Int. Cl.[4] ..... B65D 43/24

[52] U.S. Cl. ..... 220/335; 220/342; 220/343; 220/338; 16/381; 16/386; 16/257; 16/374; 16/DIG. 13; 16/260; 16/356

[58] Field of Search ..... 220/335, 342, 338, 343; 16/381, 257, 260, 374, 356, 386, DIG. 13

[56] References Cited

U.S. PATENT DOCUMENTS 3,962,750 6/1976 Buss et al. ..... 16/381

4,343,412 8/1982 Wilcox et al. ..... 220/342

*Primary Examiner*—George T. Hall

*Attorney, Agent, or Firm*—Vinson & Elkins

[57] ABSTRACT

A hinge (16) pivotally connects a lid (14) to a body (12) of a container (10) for releasably holding the cover (14) at both open and closed positions. The hinge (16) has a pair of hinge leaves (22, 22A) and a boss (48) extending from one leaf (22) forms an outer cam surface having a pair of relatively flat cam portions (50, 52) on opposed sides of a high point (54) of the cam. The other leaf (22A) has a lip (42A) extending therefrom with the inner surface of the lip (42A) riding along the outer surface of the cam formed by the one leaf (22) to define a cam follower which forms a latch member. A high portion (54) of the cam by contacting the lip (42A) restrains movement of the cover (14) at both the open and closed positions thereof until an opening force of a predetermined magnitude is exerted against the cover (14) for moving the lip (42A) over the high portion (54) of the cam. The hinge (16) may be formed of identical hinge leaves (22, 22A) thereby to simplify the manufacture and assembly of the hinge (16).

20 Claims, 14 Drawing Figures

FIG.1
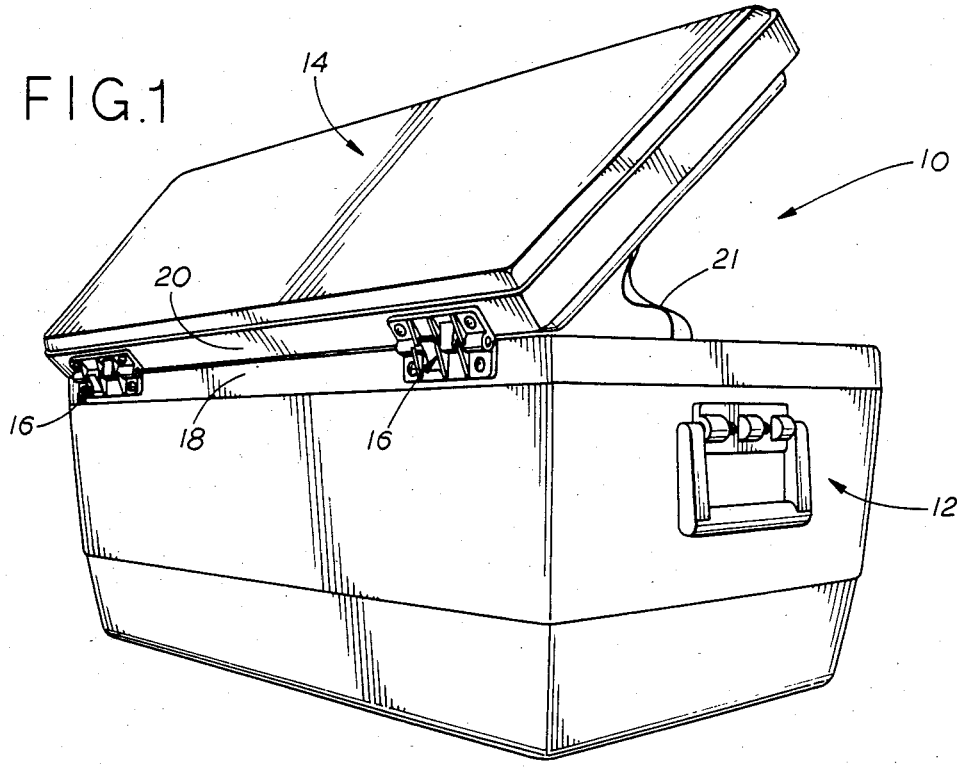
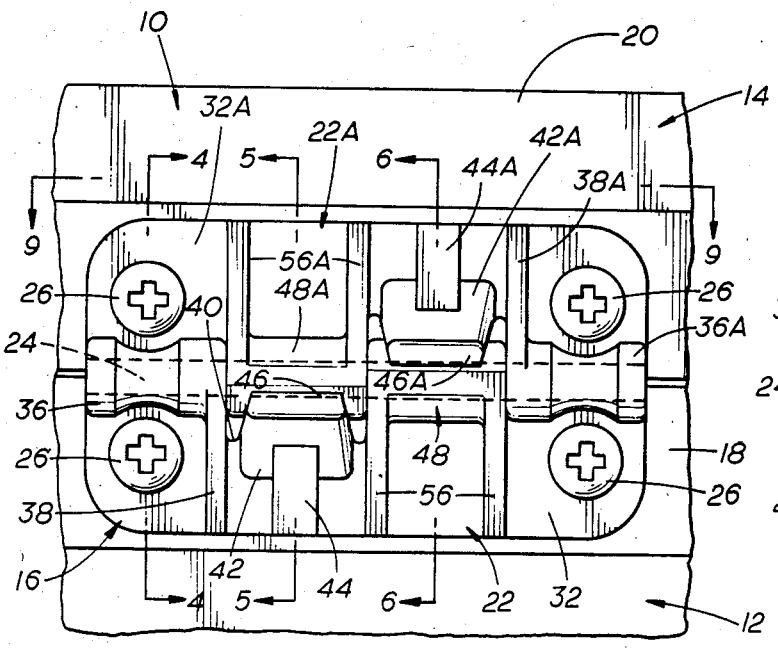
FIG.2
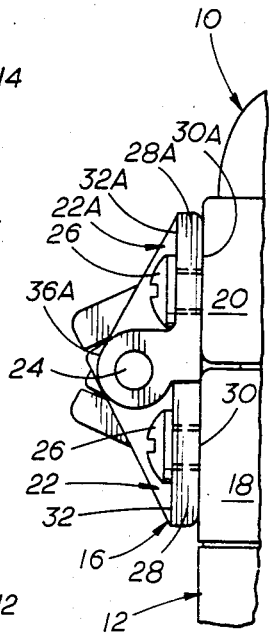
FIG.3

HINGE CONSTRUCTION FOR CONTAINER COVERS

BACKGROUND OF THE INVENTION

This invention relates to a hinge construction for pivotally connecting a cover to the body of a container, and more particularly to such a hinge construction in which the cover is releasably latched by the hinge in an open position to permit access to the container while the cover is releasably maintained in an open position.

Heretofore, such as shown in U.S. Pat. No. 3,962,750 dated June 15, 1976 hinges have been provided on insulated containers for mounting the cover or lid of the container to the body. However, particularly upon opening the cover and swinging the cover rearwardly, substantial radial forces are exerted on the hinges upon the cover reaching a full open position and this sometimes results in a pulling out of the screws holding the hinge portions on the container. The container shown in U.S. Pat. No. 3,962,750 has tongue and groove sockets formed in its body and cover to receive the hinge leaves and thereby transmit axial loads to the body and cover through the sockets. This minimizes any pullout of the screws.

Furthermore, it has been known heretofore to provide hinges which are adapted to limit the opening movement of a lid, for example. As shown in U.S. Pat. No. 2,527,318 dated Oct. 24, 1950 an upper cover or lid has a hinge on which a lug is provided to engage a wall of a lower body section upon opening of the lid thereby to limit the opening movement of the cover. Likewise, U.S. Pat. No. 3,388,421 dated June 18, 1968 provides stops on an upper pivotally mounted cover or lid to restrict the swinging movement of the cover.

A self-latching hinge is shown in U.S. Pat. No. 3,972,090 dated Aug. 3, 1976 as mounted on a door with a hinge snapping closed to releasably hold the door in a closed position until a sufficient force is exerted to open the hinge and door against the force of the latching members. U.S. Pat. No. 4,135,273 dated Jan. 23, 1979 shows a door hinge in which the hinge pin has a central reduced diameter portion in which interfitting portions of adjacent hinge leaves are received for holding the hinge leaves in position.

BRIEF SUMMARY OF THE INVENTION

This invention relates to a hinge construction for a container having a body and a lid mounted for pivotal movement on the body to permit access to the body. The container may be an insulated plastic container which may be utilized as an ice chest for cold drinks or the like as well known. The improved hinge mounts the lid for pivotal movement between a closed generally horizontal position over the container and an open generally vertical position. The hinge includes a pair of interfitting leaves, one leaf being mounted on the upper marginal portion of the body and the other interfitting leaf being mounted on the lower marginal portion of the cover or lid to permit pivotal movement of the cover.

The hinge is formed so that upon swinging of the cover to an open position at around ninety-five (95) degrees from the closed horizontal position and slightly past a dead outer vertical position, the hinge acts as a latch to releasably latch the cover in open position so taht the cover must be manually pushed or urged back to a closed position past the dead center vertical position. In order to prevent excessive opening force being exerted on the hinge itself upon movement of the lid to the full open position, a flexible strap is mounted between the lid and the cover to restrict swinging movement of the cover to the open position past around ninety-five (95) degrees with respect to the closed horizontal position.

The cover is releasably latched at both the open and closed positions by an eccentric cam surface on a boss extending from one leaf and a cam follower on the other interfitting leaf engaging the cam surface. The eccentric cam surface on one leaf includes a pair of generally flat cam surface portions on opposed sides of a high point on the cam surface. The cam follower formed by an extending lip on the other leaf is seated or positioned adjacent one flat portion in a closed position of the cover and seated adjacent the other flat portion in an open position of the cover with the high point being intermediate the open and closed positions for providing resistance to swinging movement of the cover from both closed and open positions. Thus, the eccentric cam surface and cam follower form cooperating latching members for releasably latching the cover at both open and closed positions in a generally snap action after the cam follower rides over the high point of the cam. Upon swinging movement of the cover from the open or closed position, a resistance to such swinging movement progressively increases until the cam follower rides over the high point of the cam.

The cam follower which rides along the eccentric cam defines a latch member and is formed by an extending resilient lip or finger, and the eccentric cam portion urges or forces the latch member outwardly as the latch member rides over the high midpoint of the cam surface. The amount of force required to move the cover from the open position to a closed position, or from a closed position to an open position, may be determined by the amount of resilience in the latch member formed by this extending lip and the curvature or shape of the cam surface portions adjacent the high point of the eccentric cam surface. At the fully open and fully closed positions of the cover, the lip normally does not exert any bias against the eccentric cam surface.

It is an object of this invention to provide an improved hinge construction for a container which includes a pair of interfitting leaves cooperating to releasably latch a cover on the body of a container at a closed position and at an open position slightly past a dead center position of the cover.

Another object of this invention is to provide such a hinge construction for a cover on the body of a container which releasably latches the cover in an open position upon swinging of the cover past a dead center vertical portion with the swinging movement of the cover restrained by a flexible strap extending between the cover and the body of the container.

A further object of this invention is to provide such a hinge constoruction in which the hinge is formed of a pair of identical interfitting leaves so that it is only necessary to manufacture a single leaf design thereby to simplify manufacture and assembly of the hinges.

The hinge construction of the present invention is particularly adapted for being formed from a molded plastic material, and a boss extending from one leaf has an outer eccentric cam surface thereof. The other interfitting leaf has an extending lip riding along the eccentric cam surface formed on the opposed boss to define a latch member at the open and closed positions of the cover. The lip has a predetermined resilience to determine the opening force necessary to open the cover against the eccentric cam surface. The hinge pin has a reduced diameter intermediate portion which receives projecting portions of the leaves for holding the leaves in interfitting relation to each other.

Other objects, features and advantages in this invention will become more apparent after referring to the following specifications and drawings.

DESCRIPTION OF THE INVENTION

FIG. 1 is a perspective of a container having a lid or cover thereon for movement between open and closed positions and connected by a pair of hinges comprising the present invention;

FIG. 2 is an enlarged front elevation of one of the hinges shown in FIG. 1 for connecting the cover to the body of the container with the cover being shown in a closed horizontal position;

FIG. 3 is an end elevation of the hinge shown in FIG. 1;

Figure 4:
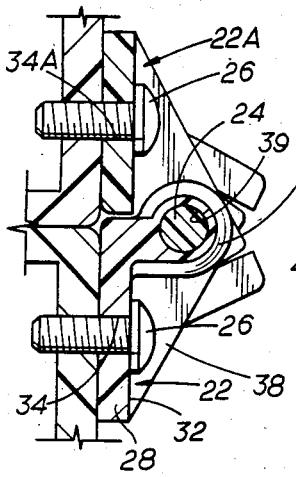
FIG. 4 is a section taken generally along line 4—4 of FIG. 2.
Figure 5:
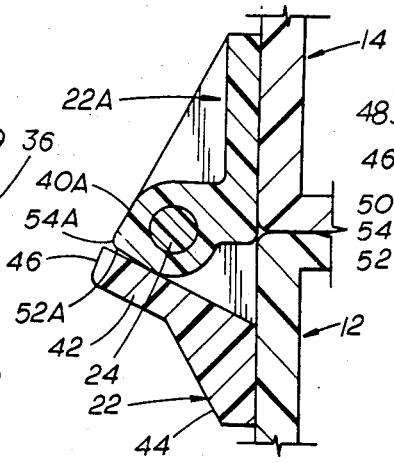
FIG. 5 is a section taken generally along line 5—5 of FIG. 2.
Figure 6:
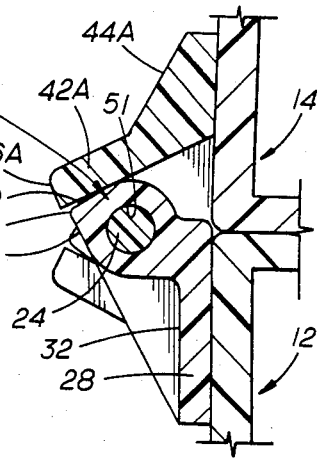
FIG. 6 is a section taken generally along line 6—6 of FIG. 2.
Figure 7:
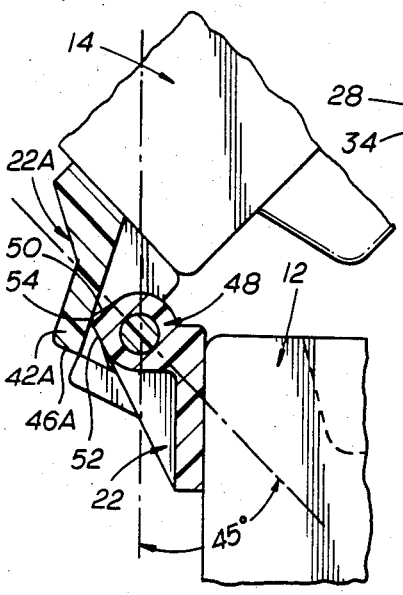
FIG. 7 is a sectional view similar to FIG. 6 but showing the lid or cover at an intermediate position between the open and closed positions thereof.
Figure 11:
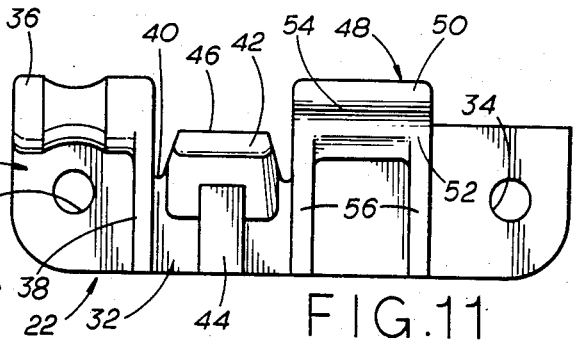
FIG. 11 is a top plan of one of the hinge leaves removed from the container.
Figure 8:
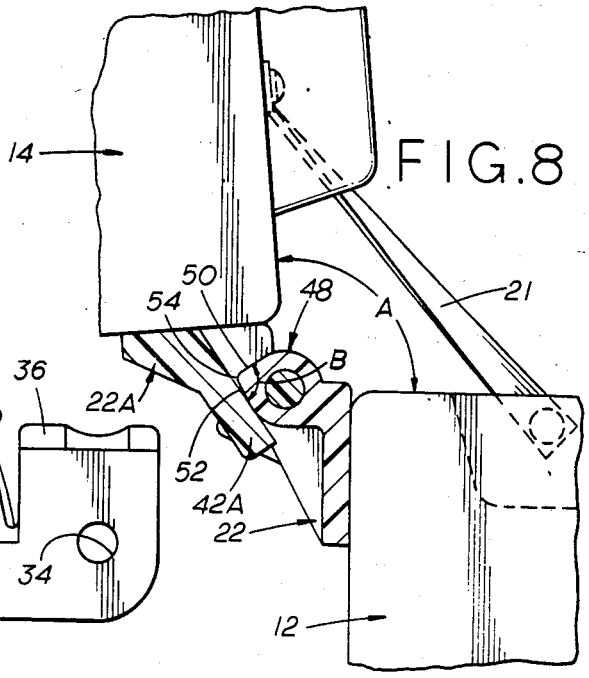
FIG. 8 is a view similar to FIG. 7 but showing the cover in a full open position slightly past a dead center vertical position with a strap between the body and cover restraining further swinging movement of the cover.
Figure 12:
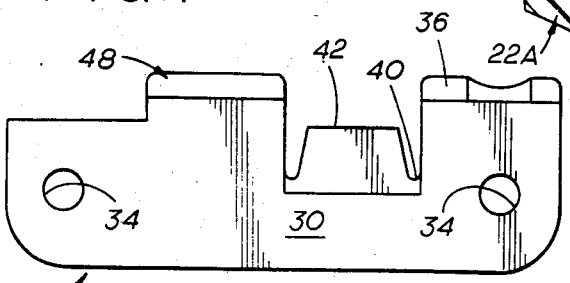
FIG. 12 is a bottom plan of the hinge leaf shown in FIG. 11.

Referring to the drawings for a better understanding of this invention, and more particularly to the preferred embodiment shown in FIGS. 1-12, an insulated container is generally indicated at 10, such as an ice chest for cold drinks or the like, for example. Container 10 preferably has relatively hard inner and outer plastic shells with suitable insulating material therebetween, such as polyurethane. Container 10 includes a body 12 and a cover or lid 14 mounted thereon movable between open and closed positions. A pair of hinges 16 extend between upper marginal portion 18 of body 12 and a lower marginal portion or rear edge 20 of cover 14 for connecting cover 14 to body 12 for swinging movement. A flexible strap 21 is secured between cover 14 and body 12 for restraining backward swinging movement of cover 14 as shown in FIG. 8.

Each hinge 16 is identical and includes a pair of identical interfitting leaves indicated generally at 22 and 22A. Leaves 22 and 22A are pivotally connected to each other by a hinge pin indicated generally at 24 and secured by screws 26 to container 10. Since hinge leaves 22 and 22A are identical, only hinge leaf 22 will be described in detail with similar parts on hinge 22A indicated by similar numerals and including the letter "A".

Hinge leaf 22 may be formed of a suitable molded plastic material, such as nylon, styrene, polpropylene, polycarbonate, or reinforced plastic, for example. Leaf 22 includes a base 28 having a planar inner surface or face 30 and planar outer face or surface 32. Openings 34 extend through base 28 and receive screws 26 therein. A sleeve-like protuberance or boss 36 projects outwardly from outer face 32 and has a reinforcing rib 38 extending between face 32 and the opposed ends of boss 36. Boss 36 has a central bore or opening 39 receiving pin 24. Base 28 has a recessed or cutaway portion thereof at 40 as shown particularly in FIGS. 11 and 12 and a projecting lip or finger indicated at 42 extends outwardly from face 32 for fitting within recessed portion 40. A reinforcing rib 44 extends from outer face 32 to a position intermediate the projection of lip 42 and thereby permits the extending free end 46 of lip 42 to deflect upon a force exerted thereupon. Lip 42 acts as a cam follower upon movement of cover 14 between open and closed positions and forms a latch member for effecting latching of cover 14 at the open and closed positions thereof as will be explained further.

A second sleeve-like boss or protuberance is indicated generally at 48 and has a central opening 51 to receive a hinge pin 24. The outer surface of boss 48 forms an eccentric cam surface defined by a pair of generally flat portions 50 and 52 which meet at an apex or juncture 54. Juncture 54 forms a high point of the cam surface as shown particularly in FIGS. 6, 7 and 8. Lip 42 has its inner surface riding along the cam surface formed by planar surfaces 50, 52, and apex 54. As shown in FIG. 8, cover 14 is shown in full open position being restrained against further rearward swinging movement by flexible strap 21 and in this position, cover 14 is at an angle A of around ninety-five (95) degrees with respect to the horizontal or upper surface of body 12. The weight of cover 14 urges cover 14 in a counterclockwise direction as shown in FIG. 8 after cover 14 passes the dead center vertical position. Angle A is preferably between around ninety-five (95) degrees and one hundred (100) degrees, but is at least ninety (90) degrees in order for the weight of cover 14 to urge cover 14 in the counterclockwise direction and thereby maintain cover 14 in open position. It is noted that surfaces 50 and 52 form an angle B therebetween as shown in FIG. 8 less than ninety (90) degrees and preferably around eighty-five (85) degrees, for example, and this permits a movement of cover 14 of around ninety-five (95) degrees.

Figure 9:
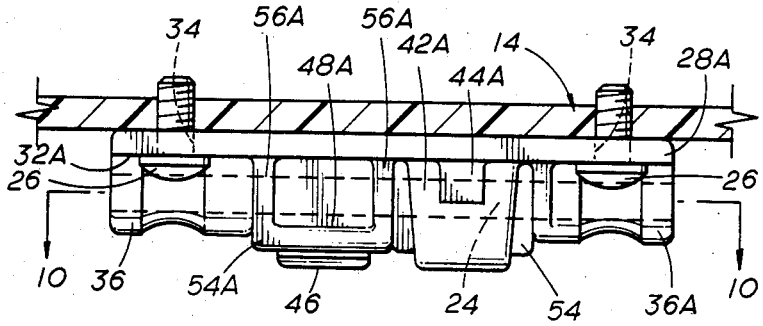
FIG. 9 is a section view taken generally along line 9—9 of FIG. 2 and showing the hinge in top plan.
Figure 10:
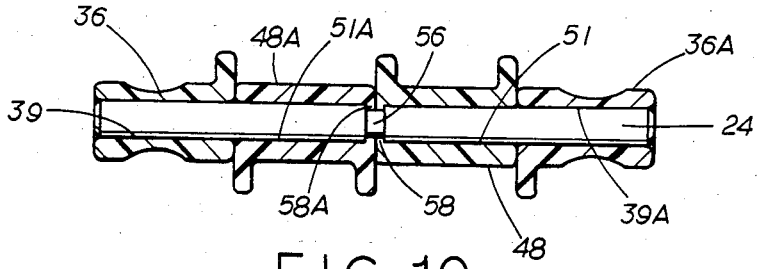
FIG. 10 is a section taken along line 10—10 of FIG. 9 and showing the hinge pin for connecting the hinge leaves together.

Reinforcement ribs 56 adjacent each end of boss 48 extend between outer face 32 and boss 48 for reinforcement thereof. Boss 48A of interfitting leaf 22A fits within opposed recess portion 40 of leaf 22 and lip 42A rides along the eccentric cam surface of boss 48 formed by planar side portions 50, 52, and high point 54. Referring to FIGS. 9 and 10, hinge pin 24 has a reduced diameter portion 56 positioned centrally of its length. Opening 51 of boss 48 has an end thereof defining an inwardly extending annular flange 58 which is resilient and is received within reduced diameter portion 56 upon insertion of pin 24 within the aligned openings 39, 39A, 51 and 51A of the interfitting hinge leaves 22 and 22a.

Referring particularly to FIGS. 6, 7, and 8, the functioning of the cam defined by the eccentric cam surface on boss 48 and the cam follower formed by lip 42A is illustrated for providing a releasable latch for cover 14 in both the closed position shown in FIG. 6 and the open position shown in FIG. 8. As shown in FIG. 6, upon an upward swinging of cover 14 from a closed horizontal position resulting from an upward force, inner surface of lip 42A engages planar cam surface 50 and high point 54 of the eccentric cam surface restrains the opening movement of cover 14. In order for cover 14 to be opened, sufficient opening force must be applied to cover 14 so that lip 42A rides over the high point 54 of the cam. The amount of opening force required may be predetermined by the amount of resilience formed in lip 42A and the amount of eccentricity of high point 54.

Upon swinging movement to the full open position shown in FIG. 8 which is slightly past a dead center position of cover 14, the inner surface of lip 42A is in engagement with flat cam portion 52 and high point 54 resists swinging movement of cover 14 to a closed position. The amount of closing force required is likewise determined by the amount of resilience in lip 42A and the height or eccentricity of high point 54 of the cam surface. By utilizing a flexible strap 21, the counterclockwise rotational force exerted by the weight of cover 14 is resisted by strap 21 and not exerted directly against hinges 16. Lip 42 provides a snap-like latching action adjacent the fully opened and closed positions of cover 14 with lip 42A acting as a latch member against the adjacent cam surface of boss 48.

Figure 13:
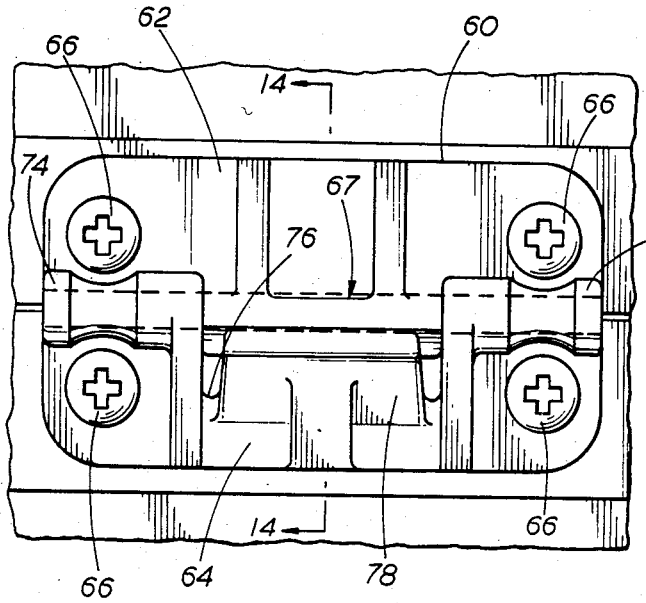
FIG. 13 is an enlarged front elevation of another embodiment of this invention in which dissimilar hinge leaves are utilized.
Figure 14:
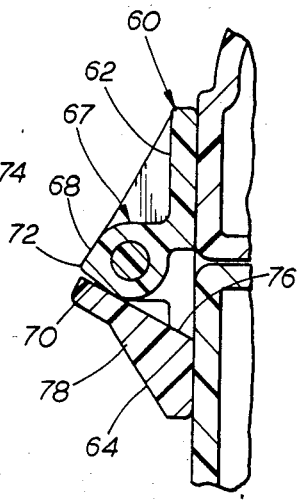
FIG. 14 is a section of the embodiment of FIG. 13 taken generally along the line 14—14 of FIG. 13.

Referring to FIGS. 13 and 14, another embodiment of the invention is shown in which dissimilar hinge leaves are utilized. Hinge 60 includes hinge leaves 62 and 64 secured by suitable screws 66 to a cover and body of a container. Hinge leaf 62 has a boss 67 thereon defining an outer cam surface having flat cam portions 68 and 70 with a high point 72 therebetween. Hinge leaf 64 has a pair of spaced sleeve-like end bosses 74 and a recessed portion 76 therebetween receives projecting lip 78 which rides along the outer eccentric cam surface formed by boss 67. The functioning of hinge 60 is similar to the functioning of the embodiment of the invention shown in FIGS. 1–12 for releasably latching a cover on a container at open and closed positions.

While preferred embodiments of the present invention have been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. A hinge adapted for use on the cover of a container for releasably holding the cover in a closed generally horizontal position over the container and releasably holding the cover in an open generally vertical position to permit access to the container; said hinge comprising:

a pair of interfitting hinge leaves each having a base forming a smooth planar surface on an inner face thereof and a projecting sleeve-like protuberance on an opposed front face thereof;

one of said leaves adapted to be secured in face-to-face abutting contact along the upper marginal portion of a container and the other of said leaves adapted to be secured in face-to-face abutting contact along the rear edge of a cover mounted for movement between a closed generally horizontal position over the container and an open generally vertical position to permit access to the container;

said protuberance on one of said interfitting leaves defining an eccentric cam surface thereon and the other of said leaves having an opposed latch member adapted to ride along the cam surface upon the movement of the cover between open and closed positions for releasably latching the cover at both the open and closed positions of the cover, said protuberances on said leaves being in axial alignment with each other and having axially aligned longitudinally extending openings therein; and a hinge pin secured within said aligned openings for pivotally connecting said hinge leaves to each other.

2. The hinge as set forth in claim 1 wherein said cam surface defined by said protuberance has a high point engaging the latch member at the position of the cover generally midway between open and closed positions thereof, said cam surface including generally flat cam surface portions on opposite sides of said high point with said latch member engaging and being seated on said generally flat cam surface portions at the open and closed positions of said cover.

3. The hinge as set forth in claim 2 wherein the generally flat cam portions extend in planes generally parallel to the pivotal axis of the hinge and are positioned at an angle in relation to each other less than around ninety (90) degrees.

4. The hinge as set forth in claim 1 wherein each of said leaves is generally identical with each leaf having a protuberance defining a cam surface and a separate latch member.

5. A hinge adapted for use on the closure member of a container for releasably holding the closure member in an open position relative to the body of the container to permit access to the container; said hinge comprising:

a pair of interfitting leaves each having a base defining a rear face and an opposed front face;

a boss extending outwardly from the front face of each of said leaves and having a longitudinally extending opening therethrough, the bosses on the interfitting leaves being in axial alignment with each other and having axially aligned longitudinally extending openings therein;

a hinge pin received in said axially aligned openings for pivotally connecting said hinge leaves to each other;

a cam surface on one of said leaves and a latch member on the other of said leaves in opposed relation to said cam surface and adapted to ride along said cam surface in contact relation thereof, said cam surface having a high point thereof in engagement with said latch member at a position of the closure member intermediate open and closed positions of the closure member, and a relatively flat cam surface portion adjacent said high point for contacting said latch member in the open position of the closure member for releasably holding the closure member in an open position.

6. The hinge as set forth in claim 5 wherein said latch member comprises a lip extending upwardly from the front face of said other leaf and said base has a recessed portion adjacent said lip, said cam surface of said one leaf extending from the front face thereof within said recessed portion, said lip being resilient and urged outwardly upon contact with the high point of said cam surface upon movement of the closure member between open and closed positions and in contact with said relatively flat cam surface at the open position of the closure member.

7. The hinge as set forth in claim 5 wherein a flexible strap is secured between said closure member and said body of the container and restricts swinging movement of the closure member from a closed portion past around one hundred (100) degrees to a full open position.

8. The hinge as set forth in claim 5 wherein said cam surface on one of said leaves defines a pair of generally flat cam surface portions arranged at an angle therebetween of less than around ninety (90) degrees with said latch member engaging said cam surface portions at the open and closed positions of the closure member for releasably holding its closure member at said open and closed positions.

9. The hinge as set forth in claim 5 wherein each of said leaves is identical with each leaf having a protuberance defining a cam surface and a latch member defining a cam follower for riding along said cam surfce.

10. A molded plastic hinge mounted between the cover and body of a container for releasably holding the cover in an open generally vertical position relative to the container body to permit access to the container; said hinge comprising:

a pair of interfitting leaves each having a base defining a rear face and an opposed front face;

a boss extending outwardly from the front face of each of said leaves and having a longitudinally extending opening therethrough, the bosses on the interfitting leaves being in axial alignment with each other and having axially aligned longitudinally extending openings therein;

a hinge pin fitting within said axially aligned openings for pivotally connecting said hinge leaves to each other;

said boss on one of said leaves defining a cam surface thereon and the other of said leaves having an opposed latch member defining an extending lip adapted to ride along said cam surface in contact relation thereto, said cam surface having a high point thereof in engagement with said lip at a position of the cover intermediate its open and closed positions, and a relative flat cam surface portion adjacent said high point for contact of said lip in the open generally vertical position of the cover for releasably holding the cover in an open position, said lip being resilient and urged outwardly upon contact with the high point of said cam surface upon movement of the cover between open and closed positions.

11. In a container having a body and a lid over the body to permit access to the body; an improved hinge mounting the lid for pivotal movement between a closed general horizontal position over the container and an open generally vertical position; said improved hinge comprising:

a pair of interfitting leaves each having a base defining a rear face and an opposed front face;

a boss extending outwardly from the front face of each of said leaves and having a longitudinally extending opening therethrough, the bosses on the interfitting leaves being in axial alignment with each other and having axially aligned longitudinally extending openings therein;

a hinge pin received in said axially aligned openings for pivotally connecting said hinge leaves to each other; and a cam surface on one of said leaves and a latch member on the other of said leaves in opposed relation to said cam surface and adapted to ride along said cam surface in contact relation thereto, said cam surface having a high point thereof in engagement with said latch member at a position of the cover intermediate its open and closed positions, and a relatively flat cam surface portion adjacent said high point for contacting said latch member in the open generally vertical position of the cover for releasably holding the cover in an open position.

12. In a container as set forth in claim 11 wherein said latch member comprises a lip extending upwardly from the front face of the base of said other leaf, said one leaf having a recessed portion in its base in opposed relation to said lip and receiving said lip therein, said lip being resilient and urged outwardly upon contact with the high point of said cam surface upon movement of the cover between open and closed positions.

13. In a container as set forth in claim 11 wherein each of said leaves is identical with each leaf having a boss defining a cam surface and a separate latch member adjacent the boss.

14. In a container as set forth in claim 11 wherein said cam surface on said boss defines a pair of generally flat cam surface portions on opposed sides of said high point, and said latch member is releasably secured by contact with said flat surface portions in the open and closed positions of said lid.

15. In a container as set forth in claim 11 wherein a flexible strap is connected between the body and the lid of the container to restrain pivotal movement of the lid past around one hundred (100) degrees of travel from its horizontal closed position to the full open position of the lid, and said latch member releasably maintains said lid in open position and resists return movement to closed position from open position.

16. In a container as set forth in claim 11 wherein a hinge pin is received within the axially aligned openings of said bosses for pivotally connecting the hinge leaves to each other, said hinge pin having a reduced diameter portion intermediate its length, and the axially aligned openings in said leaves have reduced diameter portions defining annular flanges fitting within the reduced diameter portion of said hinge pin to retain the pin within said axially aligned openings.

17. In a container having a body and a closure member mounted on the body for movement between an open position to permit access to the body and a closed position to restrict access to the body; an improved hinge mounting the closure member for pivotal movement between the closed and open positions comprising:

a pair of interfitting leaves each having a base defining a rear face and an opposed front face; and cooperating latch members on said leaves in engagement with each other at the closed portion of the closure member to releasably restrain swinging movement of the closure member to open position and responsive to a predetermined outward force to permit swinging movement to the open position;

said cooperating latch members at the open position of the closure member releasably restraining a inward swinging movement of the closure member to closed position and responsive to a predetermined inward force to permit swinging movement of the closure member to closed position.

18. In a container as set forth in claim 17 wherein a flexible strap is connected between the body and closure member of the container to restrain swinging movement of the closure member at the full open position of the closure member.

19. In a container as set forth in claim 18 wherein each of said leaves is identical with each leaf having an eccentric cam and an adjacent cam follower.

20. A molded plastic hinge mounted between a closure member and an open sided body for releasably holding the closure member in an open position relative to the body to permit access to the body; said hinge comprising:

a pair of interfitting leaves each having a base defining a rear face and an opposed front face;

a boss extending outwardly from the front face of each of said leaves and having a longitudinally extending opening therethrough, the bosses on the interfitting leaves being in axial alignment with each other and having axially aligned longitudinally extending openings therein;

a hinge pin fitting within said axially aligned openings for pivotally connecting said hinge leaves to each other;

said boss on one of said leaves defining a cam surface thereon and the other of said leaves having an opposed latch member defining an extending lip adapted to ride along said cam surface in contact relation thereto, said cam surface having a high point thereof in engagement with said lip at a position of the closure member intermediate its open and closed positions, and a relative flat cam surface portion adjacent said high point for contact of said lip in the open generally vertical position of the closure member for releasably holding the closure member in an open position, said lip being resilient and urged outwardly upon contact with the high point of said cam surface upon movement of the closure member between open and closed positions.

* * * * *